US005718293A

United States Patent [19]

Flynn et al.

[11] Patent Number: 5,718,293

[45] Date of Patent: Feb. 17, 1998

[54] FIRE EXTINGUISHING PROCESS AND COMPOSITION

[75] Inventors: Richard M. Flynn, Mahtomedi; Scott D. Thomas, Woodbury, both of Minn.

[73] Assignee: Minnesota Mining and Manufacturing Company, St. Paul, Minn.

[21] Appl. No.: 573,190

[22] Filed: Dec. 15, 1995

Related U.S. Application Data

[63] Continuation-in-part of Ser. No. 375,817, Jan. 20, 1995, abandoned.

[51] Int. Cl.[6] ..... A62D 1/00; A62D 1/08

[52] U.S. Cl. ..... 169/45; 169/46; 169/47; 252/2; 252/8

[58] Field of Search ..... 252/2, 8, 364, 252/69; 169/46, 47, 45

[56] References Cited

U.S. PATENT DOCUMENTS

| | | | |
|---|---|---|---|
| 3,278,615 | 10/1966 | Larsen et al. | 260/652.5 |
| 3,453,333 | 7/1969 | Litt et al. | 568/684 |
| 3,516,938 | 6/1970 | Zisman et al. | 510/364 |
| 3,542,859 | 11/1970 | Litt et al. | 562/504 |
| 3,549,711 | 12/1970 | Merrill et al. | 568/683 |
| 3,854,871 | 12/1974 | Eanzel | 8/142 |
| 3,879,297 | 4/1975 | Languille et al. | 252/8 |
| 3,882,182 | 5/1975 | Benninger et al. | 260/584 C |
| 3,897,502 | 7/1975 | Russell et al. | 568/683 |
| 3,900,372 | 8/1975 | Childs et al. | 205/430 |
| 3,903,012 | 9/1975 | Brandreth | 252/194 |
| 3,957,672 | 5/1976 | Zisman et al. | 510/364 |
| 3,962,460 | 6/1976 | Croix et al. | 424/342 |
| 3,976,788 | 8/1976 | Regan | 424/342 |
| 3,981,928 | 9/1976 | Pavlik | 252/186.1 |
| 4,559,154 | 12/1985 | Powell | 252/99 |
| 4,961,321 | 10/1990 | O'Neill et al. | 62/114 |
| 5,023,009 | 6/1991 | Merchant | 252/67 |
| 5,023,010 | 6/1991 | Merchant | 252/69 |
| 5,026,498 | 6/1991 | Merchant | 510/177 |
| 5,040,609 | 8/1991 | Dougherty, Jr. et al. | 169/45 |
| 5,084,190 | 1/1992 | Fernandez | 252/8 |
| 5,089,152 | 2/1992 | Flynn et al. | 252/194 |
| 5,091,104 | 2/1992 | Van Der Puy | 252/171 |
| 5,098,595 | 3/1992 | Merchant | 252/67 |
| 5,115,868 | 5/1992 | Dougherty, Jr. et al. | 169/45 |
| 5,117,917 | 6/1992 | Robin et al. | 169/46 |
| 5,124,053 | 6/1992 | Iikubo et al. | 252/8 |
| 5,125,978 | 6/1992 | Flynn et al. | 134/2 |
| 5,141,654 | 8/1992 | Fernandez | 252/8 |
| 5,157,159 | 10/1992 | Janulis et al. | 568/677 |
| 5,169,873 | 12/1992 | Behme et al. | 521/114 |
| 5,250,200 | 10/1993 | Sallet | 252/8 |
| 5,264,462 | 11/1993 | Hodson et al. | 521/88 |
| 5,268,122 | 12/1993 | Rao et al. | 510/411 |
| 5,275,669 | 1/1994 | Van Der Puy et al. | 134/42 |
| 5,298,083 | 3/1994 | Van Der Puy et al. | 134/42 |
| 5,352,378 | 10/1994 | Mathisen et al. | 252/54 |
| 5,382,704 | 1/1995 | Krespan et al. | 568/683 |
| 5,393,438 | 2/1995 | Fernandez | 252/8 |
| 5,444,102 | 8/1995 | Nimitz et al. | 521/131 |
| 5,536,327 | 7/1996 | Kaiser | 134/1 |

FOREIGN PATENT DOCUMENTS

| | | |
|---|---|---|
| 2115984 | 8/1994 | Canada . |
| 0 450 855 | 10/1991 | European Pat. Off. . |
| 0 454 109 | 10/1991 | European Pat. Off. . |
| 0 496 899 | 8/1992 | European Pat. Off. . |
| 2 287 432 | 5/1976 | France . |
| 1 294 949 | 5/1969 | Germany . |
| 1 302 054 | 2/1970 | Germany . |
| 6-192154 | 7/1994 | Japan . |
| 6-293685 | 10/1994 | Japan . |
| 6-293686 | 10/1994 | Japan . |
| 7-25803 | 1/1995 | Japan . |
| 8-259995 | 10/1996 | Japan . |
| 1427780 | 9/1990 | U.S.S.R. . |
| 1193122 | 5/1970 | United Kingdom . |
| 2 274 462 | 7/1994 | United Kingdom . |
| WO 92/22678 | 12/1992 | WIPO . |
| 93/09272 | 5/1993 | WIPO . |
| WO 93/11201 | 6/1993 | WIPO . |
| WO 93/11280 | 6/1993 | WIPO . |
| WO 93/24586 | 12/1993 | WIPO . |
| 94/20588 | 9/1994 | WIPO . |
| WO 94/26837 | 11/1994 | WIPO . |

OTHER PUBLICATIONS

J. Chem. Therm. 23, 699 (1991).

Climate Change: The IPCC scientific Assessment, Cambridge University Press (1990).

Cooper et al., Atmos. Environ. 26A, 7, 1331 (1992).

B. Ellis, Cleaning and Contamination of Electronics Components and Assemblies, Electrochemical Publications Limited, Ayr, Scotland, pp. 182–194 (1986).

D. England, J. Org. Chem. 49, 4007 (1984).

Evans et al., J. Org. Chem. 33, 1839 (1968).

Fisher et al., Nature 344, 513 (1990).

Kobler et al., Justus Liebigs Ann Chem. 1978, 1937.

NFPA (National Fire Protection Association) 2001 Standard on Clean Agent Fire Extinguishing Systems, Section A–3–4.2.2, 1994 Edition.

J. E. Malcolm, Engineer Research and Development Laboratories, Fort Belvoir, Virginia, "Vaporizing Fire Extinguishing Agents," Interim Report 1177, Aug. 18, 1950.

Misaki et al., 1994 International CFC and Halon Alternatives Conference, Washington, D.C., Oct. 24–26, 1994, "Development of a New Refigerant, " pp. 114–120.

(List continued on next page.)

*Primary Examiner*—Joseph D. Anthony

*Attorney, Agent, or Firm*—Lucy C. Weiss

[57] ABSTRACT

A process for controlling or extinguishing fires comprises introducing to a fire or flame (e.g., by streaming or by flooding) a non-flammable extinguishment composition comprising at least one mono- or dialkoxy-substituted perfluoroalkane, perfluorocycloalkane, perfluorocycloalkyl-containing perfluoroalkane, or perfluorocycloalkylene-containing perfluoroalkane compound, the compound optionally containing additional catenary heteroatoms in its perfluorinated portion and preferably having a boiling point in the range of from about 0° C. to about 150° C. The compounds exhibit good extinguishment capabilities while being environmentally acceptable.

11 Claims, No Drawings

OTHER PUBLICATIONS

Schmoltner et al., J. Phys. Chem. 97, 8976 (1993).
SNAP Technical Background Document: Risk Screen on the Use of Substitues For Class I Oxone–Depleting Substances: Fire Suppression and Explosion Protection, U.S. EPA (Mar. 1994).
M. C. Sneed and R. C. Brasted, *Comprehensive Inorganic Chemistry*, vol. Six (The Alkali Metals), pp. 61–64, D. Van Nostrand Company, Inc., New York (1957).
Suga et al., Abstracts of the 14th International Symposium on Flourine Chemistry, Yokohama, Japan, Abstract No. 4B04, "Properties of Flourinated Ethers," p. 78 (1994).
Y. Tang, *Atmospheric Fate of Various Flouracarbons*, M.S. Thesis, Massachusetts Institute of Technology (1993).
Tapscott et al., Halon Options Technical Working Conference Proceedings (1994).
Wang et al., J. Atmos. Sci. 38, 1167 (1981).
Wang et al., J. Geophys. Res. 90, 12971 (1985).
M. Yamabe, International Conference on CFC and BFC (Halons), Shanghai, China, Aug. 7–10, 1994, "Development of CFC Alternatives for Solvent Use," pp. 24–30.
Yamashita et al., International Conference on CFC and BFC (Halons), Shanghai, China, Aug. 7–10, 1994, "Development of CFC Alternatives Containing Oxygen Atom," pp. 55–58.
Young et al., J. Am. Chem. Soc. 71, 2432 (1949).
Zhang et al., J. Phys. Chem. 98(16), 4312 (1994).
P. Zurer, "Looming Ban on Production of CFCs, Halons Spurs Switch to Substitutes," Chemical & Engineering News, p. 12, Nov. 15, 1993.

FIRE EXTINGUISHING PROCESS AND COMPOSITION

This application is a continuation-in-part of application Ser. No. 08/375,817 filed Jan. 20, 1995 now abandoned.

FIELD OF THE INVENTION

This invention relates to fire extinguishing compositions comprising at least one partially-fluorinated compound and to processes for extinguishing, controlling, or preventing fires using such compositions.

BACKGROUND OF THE INVENTION

Various different agents and methods of fire extinguishment are known and can be selected for a particular fire, depending upon its size and location, the type of combustible materials involved, etc. In fixed enclosures (e.g., computer rooms, storage vaults, telecommunications switching gear rooms, libraries, document archives, petroleum pipeline pumping stations, and the like), halogenated hydrocarbon fire extinguishing agents have traditionally been utilized. Such agents are not only effective but, unlike water, also function as "clean extinguishing agents," causing little, if any, damage to the enclosure or its contents.

The most commonly-used halogenated hydrocarbon extinguishing agents have been bromine-containing compounds, e.g., bromotrifluoromethane ($CF_3Br$, Halon 1301) and bromochlorodifluoromethane ($CF_2ClBr$, Halon 1211). Such bromine-containing halocarbons are highly effective in extinguishing fires and can be dispensed either from portable equipment or from an automatic room flooding system activated by a fire detector. However, the compounds have been linked to ozone depletion. The Montreal Protocol and its attendant amendments specified that Halon 1211 and 1301 production be discontinued (see, e.g., P. S. Zurer, "Looming Ban on Production of CFCs, Halons Spurs Switch to Substitutes," Chemical & Engineering News, page 12, November 15, 1993).

Thus, there has developed a need in the art for substitutes or replacements for the commonly-used, bromine-containing fire extinguishing agents. Such substitutes should have a low ozone depletion potential; should have the ability to extinguish, control, or prevent fires or flames, e.g., Class A (trash, wood, or paper), Class B (flammable liquids or greases), and/or Class C (electrical equipment) fires; and should be clean extinguishing agents, i.e., be electrically non-conducting, volatile or gaseous, and leave no residue. Preferably, substitutes will also be low in toxicity, not form flammable mixtures in air, have acceptable thermal and chemical stability for use in extinguishing applications, and have short atmospheric lifetimes and low global warming potentials.

Various different fluorinated hydrocarbons have been suggested for use as fire extinguishing agents. For example, U.S. Pat. Nos. 5,040,609 and 5,115,868 (Dougherty et al.) describe a process for extinguishing, preventing, and controlling fires using a composition containing $CHF_3$.

U.S. Pat. No. 5,084,190 (Fernandez) discloses a process for extinguishing, preventing, and controlling fires using a composition containing at least one fluoro-substituted propane.

U.S. Pat. No. 5,117,917 (Robin et al.) describes the use of completely fluorinated, saturated $C_2$, $C_3$, and $C_4$ compounds in fire extinguishment.

U.S. Pat. No. 5,124,053 (Iikubo et al.) discloses the use of highly fluorinated, saturated $C_2$ and $C_3$ hydrofluorocarbons as fire extinguishing agents.

U.S. Pat. No. 5,250,200 (Sallet) describes an environmentally safe fire fighting technique which comprises directing a fire/flame extinguishing amount of an essentially zero ODP hydrofluoroalkane compound (other than a tetrafluoroethane or pentafluoroethane) onto a burning fire or flame.

Partially-fluorinated ethers have been suggested as chlorofluorocarbon alternatives (see, e.g., Yamashita et al., International Conference on CFC and BFC (Halons), Shanghai, China, Aug. 7–10, 1994, pages 55–58).

French Patent Publication No. 2,287,432 (Societe Nationale des Poudres et Explosifs) describes new partially-fluorinated ethers and a process for their preparation. The compounds are said to be useful as hypnotic and anesthetic agents; as monomers for preparing heat-stable, fire-resistant, or self-lubricant polymers; and in phyto-sanitary and phyto-pharmaceutical fields.

German Patent Publication No. 1,294,949 (Farbwerke Hoechst AG) describes a technique for the production of perfluoroalkyl-alkyl ethers, said to be useful as narcotics and as intermediates for the preparation of narcotics and polymers.

World Patent Publication No. WO 94/20588 (Nimitz et al.) discloses fluoroiodocarbon blends useful as chlorofluorocarbon and halon replacements.

SUMMARY OF THE INVENTION

In one aspect, this invention provides a process for controlling or extinguishing fires. The process comprises introducing to a fire or flame (e.g., by streaming or by flooding) a non-flammable (under use conditions) extinguishment composition comprising at least one mono- or dialkoxy-substituted perfluoroalkane, perfluorocycloalkane, perfluorocycloalkyl-containing perfluoroalkane, or perfluorocycloalkylene-containing perfluoroalkane compound. Preferably, the extinguishment composition is introduced in an amount sufficient to extinguish the fire or flame. The compound used in the composition can optionally contain one or more additional catenary (i.e., in-chain) heteroatoms (e.g., oxygen or nitrogen) in its perfluorinated portion and preferably has a boiling point in the range of from about 0° C. to about 150° C.

In spite of their hydrogen content, the alkoxy-substituted perfluorocompounds used in the process of the invention are surprisingly effective in extinguishing fires or flames, yet most of them leave no residue (i.e., function as clean extinguishing agents). In addition, the compounds exhibit unexpectedly high stabilities in the presence of acids, bases, and oxidizing agents. The compounds are low in toxicity and flammability, have ozone depletion potentials of zero, and have short atmospheric lifetimes and low global warming potentials relative to bromofluorocarbons, bromochlorofluorocarbons, and many substitutes therefor (e.g., hydrochlorofluorocarbons and hydrofluorocarbons). Since the compounds exhibit good extinguishment capabilities while being environmentally acceptable, they satisfy the need in the art for substitutes or replacements for the commonly-used bromine-containing fire extinguishing agents which have been linked to the destruction of the earth's ozone layer.

In other aspects, this invention also provides an extinguishment composition and a process for preventing fires in enclosed areas.

DETAILED DESCRIPTION OF THE INVENTION

Compounds which can be utilized in the processes and composition of the invention are mono- or dialkoxy-substituted perfluoroalkane, perfluorocycloalkane, perfluorocycloalkyl-containing perfluoroalkane, and perfluorocycloalkylene-containing perfluoroalkane compounds. The compounds include those which contain additional catenary heteroatom(s) in the perfluorinated portion of the molecule (as well as those which do not) and can be utilized alone, in combination with one another, or in combination with other common extinguishing agents (e.g., hydrofluorocarbons, hydrochlorofluorocarbons, perfluorocarbons, chlorofluorocarbons, bromofluorocarbons, bromochlorofluorocarbons, iodofluorocarbons, and hydrobromofluorocarbons). The compounds can be solids, liquids, or gases under ambient conditions of temperature and pressure, but are preferably utilized for extinguishment in either the liquid or the vapor state (or both). Thus, normally solid compounds are preferably utilized after tranformation to liquid and/or vapor through melting, sublimation, or dissolution in liquid co-extinguishing agent. Such tranformation can occur upon exposure of the compound to the heat of a fire or flame.

A class of useful alkoxy-substituted perfluorocompounds is that which can be represented by the following general formula (I):

$$R_f—(O—R_h)_x \quad (I)$$

wherein x is an integer of 1 or 2; when x is 1, $R_f$ is selected from the group consisting of linear or branched perfluoroalkyl groups having from 2 to about 8 carbon atoms, perfluorocycloalkyl-containing perfluoroalkyl groups having from 5 to about 8 carbon atoms, and perfluorocycloalkyl groups having from 4 to about 8 carbon atoms; when x is 2, $R_f$ is selected from the group consisting of linear or branched perfluoroalkanediyl groups or perfluoroalkylidene groups having from 4 to about 8 carbon atoms, perfluorocycloalkyl- or perfluorocycloalkylene-containing perfluoroalkanediyl or perfluoroalkylidene groups having from 6 to about 8 carbon atoms, and perfluorocycloalkanediyl groups or perfluorocycloalkylidene groups having from 4 to about 8 carbon atoms; and each $R_h$ is independently selected from the group consisting of alkyl groups having from 1 to about 2 carbon atoms; and wherein $R_f$ (but not $R_h$) can contain (optionally contains) one or more catenary heteroatoms. The perfluorocycloalkyl and perfluorocycloalkylene groups contained within the perfluoroalkyl, perfluoroalkanediyl, and perfluoroalkylidene groups can optionally (and independently) be substituted with, e.g., one or more perfluoromethyl groups having from 1 to about 4 carbon atoms.

Preferably, x is 1, and the compound is normally liquid or gaseous (i.e., liquid or gaseous under ambient conditions of temperature and pressure). Most preferably, x is 1; $R_f$ is selected from the group consisting of linear or branched perfluoroalkyl groups having from 3 to about 6 carbon atoms, perfluorocycloalkyl-containing perfluoroalkyl groups having from 5 to about 7 carbon atoms, and perfluorocycloalkyl groups having from 5 to about 6 carbon atoms; $R_h$ is a methyl group; $R_f$ can contain one or more catenary heteroatoms; and the sum of the number of carbon atoms in $R_f$ and the number of carbon atoms in $R_h$ is greater than or equal to 4. The perfluorocycloalkyl and perfluorocycloalkylene groups contained within the perfluoroalkyl, perfluoroalkanediyl, and perfluoroalkylidene groups can optionally (and independently) be substituted with, e.g., one or more perfluoromethyl groups.

Representative examples of alkoxy-substituted perfluorocompounds suitable for use in the processes and composition of the invention include the following compounds:

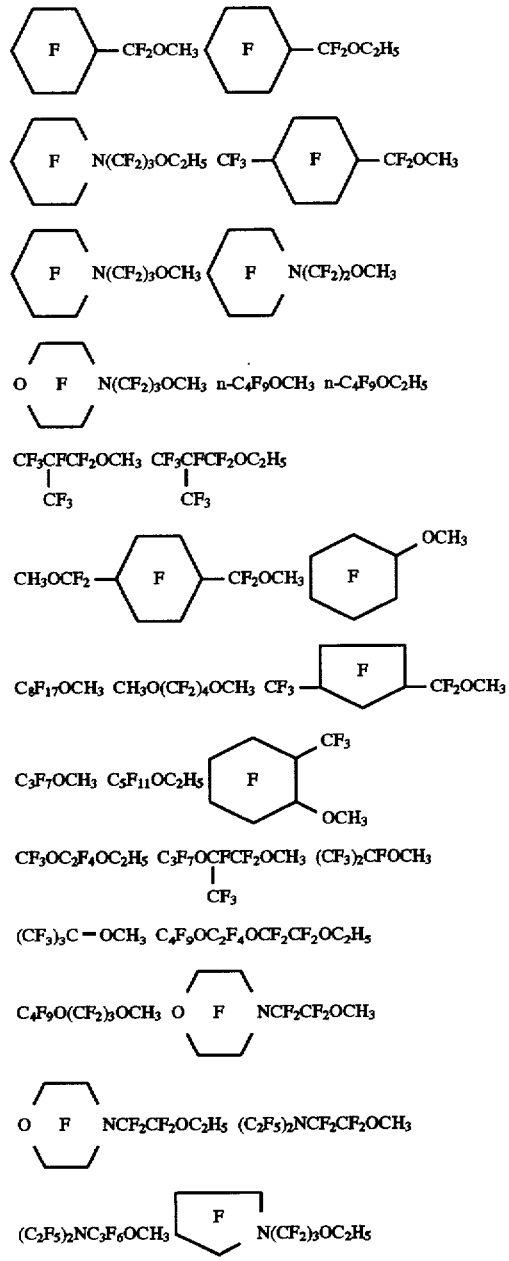

and 1,1-dimethoxyperfluorocyclohexane.

The alkoxy-substituted perfluorocompounds suitable for use in the process of the invention can be prepared by alkylation of perfluorinated alkoxides prepared by the reaction of the corresponding perfluorinated acyl fluoride or perfluorinated ketone with an anhydrous alkali metal fluoride (e.g., potassium fluoride or cesium fluoride) or anhydrous silver fluoride in an anhydrous polar, aprotic solvent. (See, e.g., the preparative methods described in French Patent Publication No. 2,287,432 and German Patent Publication No. 1,294,949, supra.) Alternatively, a fluorinated tertiary alcohol can be allowed to react with a base, e.g., potassium hydroxide or sodium hydride, to produce a perfluorinated tertiary alkoxide which can then be alkylated by reaction with alkylating agent.

Suitable alkylating agents for use in the preparation include dialkyl sulfates (e.g., dimethyl sulfate), alkyl halides (e.g., methyl iodide), alkyl p-toluenesulfonates (e.g., methyl p-toluenesulfonate), alkyl perfluoroalkanesulfonates (e.g., methyl perfluoromethanesulfonate), and the like. Suitable polar, aprotic solvents include acyclic ethers such as diethyl ether, ethylene glycol dimethyl ether, and diethylene glycol dimethyl ether; carboxylic acid esters such as methyl formate, ethyl formate, methyl acetate, diethyl carbonate, propylene carbonate, and ethylene carbonate; alkyl nitriles such as acetonitrile; alkyl amides such as N,N-dimethylformamide, N,N-diethylformamide, and N-methylpyrrolidone; alkyl sulfoxides such as dimethyl sulfoxide; alkyl sulfones such as dimethylsulfone, tetramethylene sulfone, and other sulfolanes; oxazolidones such as N-methyl-2-oxazolidone; and mixtures thereof.

Perfluorinated acyl fluorides (for use in preparing the alkoxy-substituted perfluorocompounds) can be prepared by electrochemical fluorination (ECF) of the corresponding hydrocarbon carboxylic acid (or a derivative thereof), using either anhydrous hydrogen fluoride (Simons ECF) or KF.2HF (Phillips ECF) as the electrolyte. Perfluorinated acyl fluorides and perfluorinated ketones can also be prepared by dissociation of perfluorinated carboxylic acid esters (which can be prepared from the corresponding hydrocarbon or partially-fluorinated carboxylic acid esters by direct fluorination with fluorine gas). Dissociation can be achieved by contacting the perfluorinated ester with a source of fluoride ion under reacting conditions (see the method described in U.S. Pat. No. 3,900,372 (Childs), the description of which is incorporated herein by reference) or by combining the ester with at least one initiating reagent selected from the group consisting of gaseous, non-hydroxylic nucleophiles; liquid, non-hydroxylic nucleophiles; and mixtures of at least one non-hydroxylic nucleophile (gaseous, liquid, or solid) and at least one solvent which is inert to acylating agents.

Initiating reagents which can be employed in the dissociation are those gaseous or liquid, non-hydroxylic nucleophiles and mixtures of gaseous, liquid, or solid, non-hydroxylic nucleophile(s) and solvent (hereinafter termed "solvent mixtures") which are capable of nucleophilic reaction with perfluorinated esters. The presence of small amounts of hydroxylic nucleophiles can be tolerated. Suitable gaseous or liquid, non-hydroxylic nucleophiles include dialkylamines, trialkylamines, carboxamides, alkyl sulfoxides, amine oxides, oxazolidones, pyridines, and the like, and mixtures thereof. Suitable non-hydroxylic nucleophiles for use in solvent mixtures include such gaseous or liquid, non-hydroxylic nucleophiles, as well as solid, non-hydroxylic nucleophiles, e.g., fluoride, cyanide, cyanate, iodide, chloride, bromide, acetate, mercaptide, alkoxide, thiocyanate, azide, trimethylsilyl difluoride, bisulfite, and bifluoride anions, which can be utilized in the form of alkali metal, ammonium, alkyl-substituted ammonium (mono-, di-, tri-, or tetra-substituted), or quaternary phosphonium salts, and mixtures thereof. Such salts are in general commercially available but, if desired, can be prepared by known methods, e.g., those described by M. C. Sneed and R. C. Brasted in *Comprehensive Inorganic Chemistry*, Volume Six (The Alkali Metals), pages 61–64, D. Van Nostrand Company, Inc., New York (1957), and by H. Kobler et al. in Justus Liebigs Ann. Chem. 1978, 1937. 1,4-diazabicyclo [2.2.2]octane and the like are also suitable solid nucleophiles.

The extinguishment process of the invention can be carried out by introducing a non-flammable extinguishment composition comprising at least one of the above-described alkoxy-substituted perfluorocompounds to a fire or flame. The perfluorocompounds can be utilized alone or in admixture with each other or with other commonly-used extinguishing agents, e.g., hydrofluorocarbons, hydrochlorofluorocarbons, perfluorocarbons, chlorofluorocarbons, bromofluorocarbons, bromochlorofluorocarbons, iodofluorocarbons, and hydrobromofluorocarbons. Such co-extinguishing agents can be chosen to enhance the extinguishment capabilities or modify the physical properties (e.g., modify the rate of introduction by serving as a propellant) of an extinguishment composition for a particular type (or size or location) of fire and can preferably be utilized in ratios (of co-extinguishing agent to perfluorocompound(s)) such that the resulting composition does not form flammable mixtures in air. Preferably, the perfluorocompound(s) used in the composition have boiling points in the range of from about 0° C. to about 150° C., more preferably from about 0° C. to about 110° C.

The extinguishment composition can preferably be used in either the gaseous or the liquid state (or both), and any of the known techniques for "introducing" the composition to a fire can be utilized. For example, a composition can be introduced by streaming (e.g., using conventional portable (or fixed) fire extinguishing equipment), by misting, or by flooding (e.g., by releasing (using appropriate piping, valves, and controls) the composition into an enclosed space surrounding a fire). The composition can optionally be combined with inert propellant, e.g., nitrogen, argon, or carbon dioxide, to increase the rate of discharge of the composition from the streaming or flooding equipment utilized. When the composition is to be introduced by streaming, perfluorocompound(s) having boiling points in the range of from about 20° C. to about 110° C. (especially normally liquid perfluorocompounds) can preferably be utilized. When the composition is to be introduced by misting, perfluorocompound(s) having boiling points in the range of from about 20° C. to about 110° C. are generally preferred. And, when the composition is to be introduced by flooding, perfluorocompound(s) having boiling points in the range of from about 0° C. to about 70° C. (especially normally gaseous perfluorocompounds) are generally preferred.

Preferably, the extinguishment composition is introduced to a fire or flame in an amount sufficient to extinguish the fire or flame. One skilled in the art will recognize that the amount of extinguishment composition needed to extinguish a particular fire will depend upon the nature and extent of the hazard. When the extinguishment composition is to be introduced by flooding, cup burner test data (e.g., of the type described in the Examples, infra) can be useful in determining the amount or concentration of extinguishment composition required to extinguish a particular type and size of fire.

This invention also provides an extinguishment composition comprising (a) at least one mono- or dialkoxy-substituted perfluoroalkane, perfluorocycloalkane, perfluorocycloalkyl-containing perfluoroalkane, or perfluorocycloalkylene-containing perfluoroalkane compound, the compound optionally containing additional catenary heteroatoms in its perfluorinated portion; and (b) at least one co-extinguishing agent selected from the group consisting of hydrofluorocarbons, hydrochlorofluorocarbons, perfluorocarbons, chlorofluorocarbons, bromofluorocarbons, bromochlorofluorocarbons, iodofluorocarbons, and hydrobromofluorocarbons. Preferably, co-extinguishing agent is selected from the group consisting of hydrofluorocarbons, hydrochlorofluorocarbons, perfluorocarbons, chlorofluorocarbons, bromofluorocarbons, bromochlorofluorocarbons, and hydrobromofluorocarbons; more preferably, hydrofluorocarbons, hydrochlorofluorocarbons, perfluorocarbons, and hydrobromofluorocarbons are utilized. Representative examples of co-extinguishing agents which can be used in the extinguishment composition include $CF_3CH_2CF_3$, $C_5F_{11}H$, $C_6F_{13}H$, $C_4F_9H$, $HC_4F_8H$, $CF_3H$, $C_2F_5H$, $CF_3CFHCF_3$, $CF_3CF_2CF_2H$, $CF_3CHCl_2$, $C_4F_{10}$, $C_3F_8$, $C_6F_{14}$, $C_2F_5Cl$, $CF_3Br$, $CF_2ClBr$, $CF_3I$, $CF_2HBr$, and $CF_2BrCF_2Br$. The ratio of co-extinguishing agent to perfluorocompound is preferably such that the resulting composition does not form flammable mixtures in air (as defined by standard test method ASTM E681-85).

The above-described alkoxy-substituted perfluorocompounds can be useful not only in controlling and extinguishing fires but also in preventing them. The invention thus also provides a process for preventing fires or deflagration in an air-containing, enclosed area which contains combustible materials of the non-self-sustaining type. The process comprises the step of introducing into an air-containing, enclosed area a non-flammable extinguishment composition which is essentially gaseous, i.e., gaseous or in the form of a mist, under use conditions and which comprises at least one mono- or dialkoxy-substituted perfluoroalkane, perfluorocycloalkane, perfluorocycloalkyl-containing perfluoroalkane, or perfluorocycloalkylene-containing perfluoroalkane compound, the compound optionally containing additional catenary heteroatoms in its perfluorinated portion, and the composition being introduced and maintained in an amount sufficient to impart to the air in the enclosed area a heat capacity per mole of total oxygen present that will suppress combustion of combustible materials in the enclosed area.

Introduction of the extinguishment composition can generally be carried out by flooding or misting, e.g., by releasing (using appropriate piping, valves, and controls) the composition into an enclosed space surrounding a fire. However, any of the known methods of introduction can be utilized provided that appropriate quantities of the composition are metered into the enclosed area at appropriate intervals. Inert propellants can optionally be used to increase the rate of introduction.

For fire prevention, alkoxy-substituted perfluorocompound(s) (and any co-extinguishing agent(s) utilized) can be chosen so as to provide an extinguishment composition which is essentially gaseous under use conditions. Preferred compound(s) have boiling points in the range of from about 0° C. to about 110° C.

The composition is introduced and maintained in an amount sufficient to impart to the air in the enclosed area a heat capacity per mole of total oxygen present that will suppress combustion of combustible materials in the enclosed area. The minimum heat capacity required to suppress combustion varies with the combustibility of the particular flammable materials present in the enclosed area. Combustibility varies according to chemical composition and according to physical properties such as surface area relative to volume, porosity, etc.

In general, a minimum heat capacity of about 45 cal/°C. per mole of oxygen is adequate for moderately combustible materials (e.g., wood and plastics), and a minimum of about 50 cal/°C. per mole of oxygen is adequate for highly combustible materials (e.g., paper, cloth, and some volatile flammable liquids). Greater heat capacities can be imparted if desired but may not provide significantly greater fire suppression for the additional cost involved. Methods for calculating heat capacity (per mole of total oxygen present) are well-known (see, e.g., the calculation described in U.S. Pat. No. 5,040,609 (Dougherty et al.), the description of which is incorporated herein by reference).

The fire prevention process of the invention can be used to eliminate the combustion-sustaining properties of air and to thereby suppress the combustion of flammable materials (e.g., paper, cloth, wood, flammable liquids, and plastic items) present in uninhabited enclosed areas. (The process may also be useful in inhabited areas, but toxicity testing is incomplete at this time.) The process can be used continuously if a threat of fire always exists or can be used as an emergency measure if a threat of fire or deflagration develops.

Objects and advantages of this invention are further illustrated by the following examples, but the particular materials and amounts thereof recited in these examples, as well as other conditions and details, should not be construed to unduly limit this invention.

EXAMPLES

The environmental impact of the alkoxy-substituted perfluorocompounds used in the processes and compositions of the invention was assessed by determination of the atmospheric lifetime and the global warming potential (GWP) of certain compounds, as described below:

Atmospheric Lifetime

The atmospheric lifetime ($\tau_{sample}$) of various sample compounds was calculated by the technique described in Y. Tang, *Atmospheric Fate of Various Fluorocarbons*, M. S. Thesis, Massachusetts Institute of Technology (1993). According to this technique, an ultraviolet (UV) gas cell was charged with a sample compound, a reference compound (either $CH_4$ or $CH_3Cl$), ozone, and water vapor. Hydroxyl radicals were then generated by photolytic decomposition of the ozone in the presence of the water vapor and an inert buffer gas, i.e., helium. As the sample compounds and reference compounds reacted with the hydroxyl radicals in the gas phase, their concentrations were measured by Fourier transform infrared spectroscopy (FTIR). The rate constant for reaction of the sample compound ($k_{sample}$) with hydroxyl radical was measured relative to the rate constant for a reference compound ($k_{ref}$), and the atmospheric lifetime was then calculated using the following formula (where $\tau_{CH4}$ and $k_{CH4}$ are known values):

$$\tau_{sample} = \frac{\tau_{CH4}}{\left(\frac{k_{sample}}{k_{ref}}\right)\left(\frac{k_{ref}}{k_{CH4}}\right)}$$

The rate constant for each sample compound was measured (using $CH_4$ as the reference compound and again using $CH_3Cl$) at 298K, and the atmospheric lifetime values were calculated and then averaged. The results are shown in Table A under the heading "Atmospheric Lifetime." For comparative purposes, the atmospheric lifetime for several hydrofluorocarbons is also shown in Table A.

Atmospheric lifetime was also estimated from a correlation developed between the highest occupied molecular orbital (HOMO) energy and the known atmospheric lifetimes of hydrofluorocarbons and hydrofluorocarbon ethers, in a manner similar to that described by Cooper et al. in Atmos. Environ. 26A, 7, 1331 (1992). The correlation differed from that found in Cooper et al. in the following respects: the correlation was developed using a larger data set; lifetimes for the correlations were determined by relative hydroxyl reactivity of sample to $CH_3CCl_3$ at 277K, as described by Zhang et al. in J. Phys. Chem. 98(16), 4312 (1994); HOMO energy was calculated using MOPAC/PM3, a semi-empirical molecular orbital package; and the number of hydrogen atoms present in the sample was included in the correlation. The results are reported in Table A under the heading "Estimated Atmospheric Lifetime."

Global Warming Potential

Global warming potential (GWP) was determined for the various sample compounds using the above-described calculated values for atmospheric lifetime and experimentally determined infrared absorbance data integrated over the spectral region of interest, typically 500 to 2500 $cm^{-1}$. The calculations were based on the definition of GWP set forth by the Intergovernmental Panel in Climate Change in *Climate Change: The IPCC Scientific Assessment*, Cambridge University Press (1990). According to the Panel, GWP is the integrated potential warming due to the release of 1 kilogram of sample compound relative to the warming due to 1 kilogram of $CO_2$ over a specified integration time horizon (ITH) using the following equation:

$$GWP_{sample} = \frac{\int_0^{ITH} \Delta T_x C_{ox} e^{-t/\alpha} dt}{\int_0^{ITH} \Delta T_{CO_2} C_{CO_2} dt}$$

where ΔT is the calculated change in temperature at the earth's surface due to the presence of a particular compound in the atmosphere [calculated using a spreadsheet model (using parameters described by Fisher et al. in Nature 344, 513 (1990)) derived from Atmospheric and Environmental Research, Inc.'s more complete one-dimensional radiative-convective model (described by Wang et al. in J. Atmos. Sci. 38, 1167 (1981) and J. Geophys. Res. 90, 12971 (1985)], C is the atmospheric concentration of the compound, τ is the atmospheric lifetime of the compound (the calculated value described above), and x designates the compound of interest. Upon integration, the formula is as follows:

$$GWP_{sample} = \frac{\Delta T_x C_{ox} \tau_x [1 - e^{-ITH/\alpha}]}{\Delta T_{CO_2}(1.3 \times 10^{-10})[A_1\tau_1(1 - e^{-ITH/\tau_1}) + A_2\tau_2(1 - e^{-ITH/\tau_2}) + A_3\tau_3(1 - e^{-ITH/\tau_1})]}$$

where $A_1$=0.30036, $A_2$=0.34278, $A_3$=0.35686, $\tau_1$=6.993, $\tau_2$=71.108, and $\tau_3$=815.73 in the Siegenthaler (1983) coupled ocean-atmosphere $CO_2$ model. The results of the calculations are shown in Table A below.

TABLE A

| Compound | Estimated Atmospheric Lifetime (years) | Atmospheric Lifetime (years) | Global Warming Potential (100 year ITH) |
|---|---|---|---|
| $C_2F_5$—$CH_3$ | 12.6 | | |
| $C_2F_5$—O—$CH_3$ | 1.6 | | |
| $C_3F_7$—$CH_3$ | 9.6 | | |
| $C_3F_7$—O—$CH_3$ | 1.9 | | |
| $C_4F_9$—$CH_3$ | 7.0 | | |
| $C_4F_9$—O—$CH_3$ | 1.9 | 5.5 | 330 |
| $C_4F_9$—$C_2H_5$ | 2.0 | | |
| $C_4F_9$—O—$C_2H_5$ | 0.5 | 1.2 | 70 |
| c-$C_6F_{11}$—$CH_3$ | 13.7 | | |

TABLE A-continued

| Compound | Estimated Atmospheric Lifetime (years) | Atmospheric Lifetime (years) | Global Warming Potential (100 year ITH) |
|---|---|---|---|
| c-$C_6F_{11}$—O—$CH_3$ | 1.8 | 3.8 | 170 |
| $CF_3H$ | 252 | 280* | 9000* |

*SNAP Technical Background Document: Risk Screen on the Use of Substitutes for Class 1 Ozone-Depleting Substances: Fire Suppression and Explosion Protection, U.S. EPA (March 1994).

As can be seen in Table A, each of the various alkoxy-substituted perfluorocompounds unexpectedly has a lower atmospheric lifetime than the corresponding hydrofluorocarbon, i.e., the hydrofluorocarbon having the same carbon number. The alkoxy-substituted perfluorocompounds are thus more environmentally acceptable than the hydrofluorocarbons (which have previously been proposed as chlorofluorocarbon replacements).

The chemical stability of the alkoxy-substituted perfluorocompounds used in the processes and compositions of the invention was also evaluated to determine their suitability for use in cleaning and coating applications. In these tests, a compound was contacted with a chemical agent such as aqueous sodium acetate, aqueous KOH, concentrated sulfuric acid, or potassium permanganate in acetone to determine the stability of the compound to base, acid, or oxidant, as described below:

Stability in the Presence of Base

To assess hydrolytic stability, a ten gram sample of alkoxy-substituted perfluorocompound was combined with 10 g of 0.1M NaOAc and sealed in a 2.54 cm (internal diameter) by 9.84 cm Monel™ 400 alloy (66% nickel, 31.5% copper, and 1.2% iron and several minor components) tube (available from Paar Instrument Co. of Moline, Ill. as Part Number 4713cm). The tube was heated at 110° C. in a forced air convection oven for 16 hours. After cooling to room temperature, a 1 mL sample of the tube contents was diluted with 1 mL of total ionic strength adjustment buffer (TISAB, available from Orion Research, Inc., a mixture of 1,2-cyclohexylene dinitrilotetraacetic acid, deionized water, sodium acetate, sodium chloride, and acetic acid). The concentration of fluoride ion (resulting from any reaction of the perfluorocompound with the aqueous NaOAc) was measured using an Orion Model 720A Coulombmeter with a $F^-$ specific electrode which had been previously calibrated using 0.5 and 500 ppm $F^-$ solutions. Based on the measured fluoride ion concentration, the rate at which HF had been generated by reaction of the aqueous NaOAc with the perfluorocompound was calculated. The results are shown below in Table B and indicate that the alkoxy-substituted perfluorocompounds are stable to base under these conditions.

TABLE B

| | $C_4F_9OCH_3$ | $C_4F_9OC_2H_5$ | c-$C_6F_{11}OCH_3$ |
|---|---|---|---|
| HF Generation Rate (μg/g/hr) | 0.67 | 0.22 | 0.33 |

To assess hydrolytic stability under more severely basic conditions, $C_4F_9OCH_3$ (125 g of 99.8% purity, 0.5 mole) was combined with potassium hydroxide (29.4 g, 0.45 mole, dissolved in 26.1 g water) in a 250 mL flask equipped with an overhead stirrer, a condenser, and a thermometer, and the resulting solution was refluxed at 58° C. for 19 hours. Water (50 mL) was added to the solution after refluxing, and the resulting product was distilled. The lower fluorochemical phase of the resulting distillate was separated from the upper phase and was washed with water (100 mL) to yield 121.3 g of recovered $C_4F_9OCH_3$, which was identical in purity and composition to the starting material (as shown by gas chromatography). The aqueous base solution remaining in the reaction flask was titrated with standard 1.0N HCl to reveal that none of the KOH originally charged had been consumed, indicating that the perfluorocompound was stable in the presence of the base.

Stability in the Presence of Acid

To assess hydrolytic stability under acidic conditions, $C_4F_9OCH_3$ (15 g, 0.06 mole) was combined with sulfuric acid (10 g of 96% by weight, 0.097 mole) in a 50 mL flask containing a stir bar and fitted with a reflux condenser. The resulting mixture was stirred for 16 hours at room temperature, and then the resulting upper fluorochemical phase was separated from the resulting lower sulfuric acid phase. Gas-liquid chromatographic (GLC) analysis of the fluorochemical phase revealed the presence of only the starting perfluorocompound and no detectable amount of $C_3F_7CO_2CH_3$, the expected product of hydrolysis. This result (indicating that the perfluorocompound was stable in the presence of the acid) was surprising in view of the discussion by England in J.Org. Chem. 49, 4007 (1984), which states that "[f]luorine atoms attached to carbon which also bears an alkyl ether group are known to be labile to electrophilic reagents. They are readily hydrolyzed in concentrated sulfuric acid, thus providing a route to some esters of fluoroacids."

Stability in the Presence of Oxidant

To assess oxidative stability, potassium permanganate (20 g, 0.126 mole) was dissolved in acetone, and $C_4F_9OCH_3$ (500 g of 99.9% purity, 2.0 mole) was added to the resulting solution. The solution was refluxed for four hours, with no indication that the permanganate had been consumed (as evidenced by the absence of brown $MnO_2$). The refluxed solution was then distilled into a 500 mL Barrett trap filled with water. The lower fluorochemical phase of the resulting mixture was separated from the upper phase, was washed with four 1.5 L aliquots of water, and was dried by passage through a column of silica gel to yield 471 g of resulting product. Gas chromatographic analysis of the product revealed no evidence of degradation of the starting perfluorocompound, indicating that the compound was stable in the presence of the oxidant.

Flash Point Testing

The alkoxy-substituted perfluorocompounds $C_4F_9OCH_3$, $C_4F_9OC_2H_5$, and c-$C_6F_{11}OCH_3$ were tested for flash point by the standard method defined by ASTM D3278-89. Each compound was determined to have no flash point.

Several different alkoxy-substituted perfluorocompounds were prepared for use in extinguishment, as described below:

Preparation of $C_4F_9OC_2H_5$

A 20 gallon Hastalloy C reactor, equipped with a stirrer and a cooling system, was charged with spray-dried potassium fluoride (7.0 kg, 120.3 mole). The reactor was sealed, and the pressure inside the reactor was reduced to less than 100 torr. Anhydrous dimethyl formamide (22.5 kg) was then added to the reactor, and the reactor was cooled to below 0° C. with constant agitation. Heptafluorobutyryl fluoride (22.5 kg of 58% purity, 60.6 mole) was added to the reactor contents. When the temperature of the reactor reached −20° C., diethyl sulfate (18.6 kg, 120.8 mole) was added to the reactor over a period of approximately two hours. The resulting mixture was then held for 16 hours with continued agitation, was raised to 50° C. for an additional four hours to facilitate complete reaction, and was cooled to 20° C. Then, volatile material (primarily perfluorooxacyclopentane present in the starting heptafluorobutyryl fluoride) was vented from the reactor over a three-hour period. The reactor was then resealed, and water (6.0 kg) was added slowly to the reactor. After the exothermic reaction of the water with unreacted perfluorobutyryl fluoride subsided, the reactor was cooled to 25° C., and the reactor contents were stirred for 30 minutes. The reactor pressure was carefully vented, and the lower organic phase of the resulting product was removed to afford 17.3 kg of material which was 73% $C_4F_9OC_2H_5$ (b.p.=75° C.). The product identity was confirmed by GCMS and by $^1H$ and $^{19}F$ NMR.

Preparation of $C_4F_9OCH_3$

The reaction was carried out in the same equipment and in a similar manner to the procedure of Example 7 above, but using the following materials: spray-dried potassium fluoride (6 kg, 103.1 mole), anhydrous dimethyl formamide (25.1 kg), perfluorobutyryl fluoride (58% purity, 25.1 kg, 67.3 mole), and dimethyl sulfate (12.0 kg, 95.1 mole). 22.6 kg of product was obtained, which was 63.2% $C_4F_9OCH_3$ (b.=58°–60° C.). The product identity was confirmed by GCMS and by $^1H$ and $^{19}F$ NMR.

Preparation of c-$C_6F_{11}OCH_3$

A 500 ml, 3-necked round bottom flask equipped with an overhead stirrer, an addition funnel, and a condenser was charged with anhydrous cesium fluoride (27.4 g, 0.18 mole), anhydrous diethylene glycol dimethyl ether (258 g), and dimethyl sulfate (22.7 g, 0.18 mole). Perfluorocyclohexanone (50 g, 0.18 mole) was then added dropwise to the resulting stirred mixture, and stirring was continued for 18 hours after the addition. Water (approximately 200 ml) was added to the resulting mixture, and the lower fluorochemical phase of the mixture was separated from the upper phase and washed once with saturated aqueous sodium chloride solution. Since the fluorochemical phase still contained about 12% diglyme, water was added to it, and the resulting product was azeotropically distilled to yield 32.8 g of c-$C_6F_{11}OCH_3$ (b.p.=100° C.), which was free of diglyme. The product identity was confirmed by IR, GCMS, and $^1H$ and $^{19}F$ NMR.

Preparation of $C_3F_7OCH_3$

A jacketed one liter round bottom flask was equipped with an overhead stirrer, a solid carbon dioxide/acetone condenser, and an addition funnel. The flask was charged with spray-dried potassium fluoride (85 g, 1.46 mol) and anhydrous diethylene glycol dimethyl ether (375 g) and was then cooled to about −20° C. using a recirculating refrigeration system. $C_2F_5COF$ (196 g, 1.18 mol) was added to the flask over a period of about one hour. The flask was then warmed to about 24° C., and dimethyl sulfate (184.3 g, 1.46 mol) was then added dropwise via the addition funnel over a 45 minute period. The resulting mixture was then stirred at room temperature overnight. Water (a total of 318 mL) was then added dropwise to the mixture. The mixture was transferred to a one liter round bottom flask, and the resulting product ether was azeotropically distilled. The lower product phase of the resulting distillate was separated from the upper aqueous phase, was washed once with cold water, and was subsequently distilled to give 180 g of product (b.p. 36° C.; >99.9% purity by GLC). The product identity was confirmed by GCMS and by $^1H$ and $^{19}F$ NMR.

Preparation of $C_5F_{11}OCH_3$

The title compound was prepared essentially as in Example 3 using anhydrous potassium fluoride (32 g, 0.55 mol), anhydrous diethylene glycol dimethyl ether (diglyme, 375 g), methyltrialkyl($C_8$–$C_{10}$) ammonium chloride (Adogen™ 464, available from Aldrich Chemical Company, 12.5 g), $C_4F_9COF$ (218 g of 60.7% purity, 0.5 mol), and dimethyl sulfate (69.3 g, 0.55 mol). The reaction mixture was stirred at room temperature overnight. Approximately 100 mL of 10% aqueous potassium hydroxide was then added to the mixture, and the resulting product was azeotropically distilled from the mixture. The lower phase of the resulting distillate was separated from the upper phase, was washed with water, was treated with aqueous potassium hydroxide solution (53 g of 50%), and was then refluxed for one hour. A second azeotropic distillation and water washing yielded crude product which was further purified by distillation through a ten-plate perforated column to provide the product ether (boiling range 82°–84° C.; 96.2% purity by GLC). The product identity was confirmed by GCMS and by $^1H$ and $^{19}F$ NMR.

Examples 1–4 and Comparative Examples A–D

The extinguishment capabilities of clean extinguishment compositions are most frequently tested using the cup burner test described in Section A-3-4.2.2 (entitled Flame Extinguishing Concentrations) of the NFPA (National Fire Protection Association) 2001 Standard on Clean Agent Fire Extinguishing Systems, 1994 Edition. In this test, an apparatus can be used which consists of an 8.5-cm I.D. (inner diameter) by 53-cm tall outer chimney and an inner fuel cup burner with a 3.1-cm O.D. (outer diameter) and a 2.15-cm I.D. positioned 30.5 cm below the top edge of the outer glass chimney. Air is passed through the annular region at 40 L/min from a glass bead distributor at the base of the chimney. The extinguishment composition to be evaluated is gradually added to the air stream (prior to entering the glass bead distributor) until the flame (from the fuel, e.g., heptane, being burned in the cup burner) is extinguished. A constant air flow rate of 40 L/min is maintained for all trials. The extinguishment concentration, i.e., the concentration of extinguishment composition at which the flame is extinguished, is calculated using the following formula:

$$\text{Extinguishment Concentration}=[F_1/(F_1+F_2)]\times 100\%$$

where $F_1$ is the composition flow rate in L/min and $F_2$ is the air flow rate in L/min. The above-referenced NFPA 2001 Standard reports extinguishment data for a number of known clean extinguishment compositions in Table A-3-4.2.1, and this data (along with data for the same compositions from other sources) is included in Table C below as Comparative Examples A–D.

Because the cup burner method requires a large quantity of extinguishment composition, an alternative "micro-cup burner" method has been developed which uses a much smaller quantity of composition yet provides extinguishment concentration data in good agreement with that obtained by the cup burner method. The micro-cup burner method utilizes a quartz concentric-tube laminar-diffusion flame burner (micro-cup burner, of similar design to the above-described cup apparatus) aligned vertically with all flows upward. A fuel, e.g., butane, flows at 10.0 sccm (standard cubic centimeters per minute) through a 5-mm I.D. inner quartz tube which is centered in a 15-mm I.D. quartz chimney. The chimney extends 4.5 cm above the inner tube. Air flows through the annular region between the inner tube and the chimney at 1000 sccm. Prior to the addition of extinguishment composition, a visually stable flame is supported on top of the inner tube, and the resulting combustion products flow out through the chimney. An extinguishment composition to be evaluated is introduced into the air stream upstream of the burner. Liquid compositions are introduced by a syringe pump (which is calibrated to within 1%) and are volatilized in a heated trap. All gas flows are maintained by electronic mass-flow controllers which are calibrated to within 2%. The fuel is ignited to produce a flame and is allowed to burn for 1 minute. After 1 minute, a specific flow rate of composition is introduced, and the time required for the flame to be extinguished is recorded.

Using the above-described micro-cup burner apparatus and method, extinguishment concentrations were determined for a number of alkoxy-substituted perfluorocompounds useful in the processes and composition of the invention. Comparative data was also collected for some known extinguishment compositions, and the results are shown in Table C. The extinguishment concentrations reported in Table C are the recorded volume % of extinguishment composition in air required to extinguish the flame within an average of 30 seconds or less.

TABLE C

| Example Number | Composition | Micro-cup Burner Extinguishment Concentration (volume % composition in air) | Cup Burner Extinguishment Concentration (volume % composition in air) |
|---|---|---|---|
| 1 | $C_4F_9OCH_3$ | 6.1 | |
| 2 | $C_4F_9OC_2H_5$ | 6.5 | |
| 3 | c-$C_6F_{11}OCH_3$ | 5.8 | |
| 4 | $C_3F_7OCH_3$ | 7.5 | |
| Comparative A | $CF_3H$ | 11.9 | 12[a]–12.7[a] |
| Comparative B | $CF_3Br$ | 3.0 | 2.9[a]–3.5[a] |
| Comparative C | $C_4F_{10}$ | 5.3 | 5.0[a]–5.9[a] |
| Comparative D | $C_6F_{14}$ | 4.2 | 4.0[b]–4.4[c] |

[a]reported in NFPA 2001 Standard cited supra.
[b]Determined by Applicants using the above-described NFPA 2001 Standard Cup Burner Method.
[c]Reported by Tapscott et al., Halon Options Technical Working Conference Proceedings (1994).

The data in Table C shows that the micro-cup burner method provides extinguishment concentration values which are in good agreement with those obtained by the cup burner method. The data also shows that the alkoxy-substituted perfluorocompounds used in the processes and composition of the invention are effective extinguishing agents at concentrations comparable to those required for the comparative compounds. The perfluorocompounds thus possess good extinguishment capabilities while also being environmentally acceptable.

Various modifications and alterations of this invention will become apparent to those skilled in the art without departing from the scope and spirit of this invention.

What is claimed is:

1. A process for preventing fires or deflagration in an air-containing, enclosed area which contains combustible materials of the non-self-sustaining type comprising the step of introducing into said air-containing, enclosed area a non-flammable extinguishment composition which is essentially gaseous under use conditions and which comprises at least one mono- or dialkoxy-substituted perfluoroalkane, perfluorocycloalkane, perfluorocycloalkyl-containing perfluoroalkane, or perfluorocycloalkylene-containing perfluoroalkane compound, said compound having a boiling point in the range of from about 0° C. to about 150° C. and optionally containing one or more additional catenary heteroatoms in its perfluorinated portion, and said composition being introduced and maintained in an amount sufficient to impart to the air in said enclosed area a heat capacity per mole of total oxygen present that will suppress combustion of combustible materials in said enclosed area.

2. The process of claim 1 wherein said compound has a boiling point in the range of from about 0° C. to about 110° C.

3. The process of claim 1 wherein said compound is represented by the general formula $$R_f—(O—R_h)_x,$$

wherein x is an integer of 1 or 2; when x is 1, $R_f$ is selected from the group consisting of linear or branched perfluoroalkyl groups having from 2 to about 8 carbon atoms, perfluorocycloalkyl-containing perfluoroalkyl groups having from 5 to about 8 carbon atoms, and perfluorocycloalkyl groups having from 4 to about 8 carbon atoms; when x is 2, $R_f$ is selected from the group consisting of linear or branched perfluoroalkanediyl groups or perfluoroalkylidene groups having from 4 to about 8 carbon atoms, perfluorocycloalkyl- or perfluorocycloalkylene-containing perfluoroalkanediyl or perfluoroalkylidene groups having from 6 to about 8 carbon atoms, and perfluorocycloalkanediyl groups or perfluorocycloalkylidene groups having from 4 to about 8 carbon atoms; and each $R_h$ is independently selected from the group consisting of alkyl groups having from 1 to about 2 carbon atoms; and wherein $R_f$ can contain one or more catenary heteroatoms.

4. The process of claim 3 wherein x is 1, and said compound is normally liquid or normally gaseous.

5. A process for preventing fires or deflagration in an air-containing, enclosed area which contains combustible materials of the non-self-sustaining type comprising the step of introducing into said air-containing, enclosed area a non-flammable extinguishment composition which is essentially gaseous under use conditions and which comprises at least one compound selected from the group consisting of $C_4F_9OCH_3$, $C_4F_9OC_2H_5$, c-$C_6F_{11}OCH_3$, and $C_3F_7OCH_3$, said composition being introduced and maintained in an amount sufficient to impart to the air in said enclosed area a heat capacity per mole of total oxygen present that will suppress combustion of combustible materials in said enclosed area.

6. A process for controlling or extinguishing fires comprising the step of introducing to a fire or flame a non-flammable extinguishment composition comprising at least one mono- or dialkoxy-substituted perfluoroalkane, perfluorocycloalkane, perfluorocycloalkyl-containing perfluoroalkane, or perfluorocycloalkylene-containing perfluoroalkane compound, said compound having a boiling point in the range of from about 0° C. to about 150° C. and optionally containing one or more additional catenary heteroatoms in its perfluorinated portion.

7. The process of claim 6 wherein said composition is introduced in an amount sufficient to extinguish said fire or flame.

8. The process of claim 6 wherein said compound is represented by the general formula $$R_f—(O—R_h)_x,$$

wherein x is an integer of 1 or 2; when x is 1, $R_f$ is selected from the group consisting of linear or branched perfluoroalkyl groups having from 2 to about 8 carbon atoms, perfluorocycloalkyl-containing perfluoroalkyl groups having from 5 to about 8 carbon atoms, and perfluorocycloalkyl groups having from 4 to about 8 carbon atoms; when x is 2, $R_f$ is selected from the group consisting of linear or branched perfluoroalkanediyl groups or perfluoroalkylidene groups having from 4 to about 8 carbon atoms, perfluorocycloalkyl- or perfluorocycloalkylene-containing perfluoroalkanediyl or perfluoroalkylidene groups having from 6 to about 8 carbon atoms, and perfluorocycloalkanediyl groups or perfluorocycloalkylidene groups having from 4 to about 8 carbon atoms; and each $R_h$ is independently selected from the group consisting of alkyl groups having from 1 to about 2 carbon atoms; and wherein $R_f$ can contain one or more catenary heteroatoms.

9. The process of claim 8 wherein x is 1, and said compound is normally liquid or normally gaseous.

10. The process of claim 9 wherein $R_f$ is selected from the group consisting of linear or branched perfluoroalkyl groups having from 3 to about 6 carbon atoms, perfluorocycloalkyl-containing perfluoroalkyl groups having from 5 to about 7 carbon atoms, and perfluorocycloalkyl groups having from 5 to about 6 carbon atoms; $R_h$ is a methyl group; and the sum of the number of carbon atoms in $R_f$ and the number of carbon atoms in $R_h$ is greater than or equal to 4.

11. A process for controlling or extinguishing fires comprising the step of introducing to a fire or flame a non-flammable extinguishment composition comprising at least one compound selected from the group consisting of $C_4F_9OCH_3$, $C_4F_9OC_2H_5$, c-$C_6F_{11}OCH_3$, and $C_3F_7OCH_3$.

* * * * *